US005308267A

United States Patent [19]

Hotea

[11] Patent Number: 5,308,267

[45] Date of Patent: May 3, 1994

[54] ELECTRICAL SOCKET TERMINAL

[75] Inventor: Gheorghe Hotea, Griesheim, Fed. Rep. of Germany

[73] Assignee: The Whitaker Corporation, Wilmington, Del.

[21] Appl. No.: 43,171

[22] Filed: Apr. 5, 1993

[30] Foreign Application Priority Data

Apr. 14, 1992 [GB] United Kingdom ..... 9208205.6

[51] Int. Cl.[5] ..... H01R 13/11

[52] U.S. Cl. ..... 439/851

[58] Field of Search ..... 439/842-857, 439/861, 862

[56] References Cited

U.S. PATENT DOCUMENTS

| | | | |
|---|---|---|---|
| 4,002,400 | 1/1977 | Evans | 439/851 |
| 4,550,972 | 11/1985 | Romak | 439/851 |
| 4,772,234 | 9/1988 | Cooper | 439/851 |
| 4,874,338 | 10/1989 | Bakermans | 439/831 |
| 5,188,545 | 2/1993 | Hass et al. | 439/851 |

FOREIGN PATENT DOCUMENTS

| | | | |
|---|---|---|---|
| WO89/05531 | 6/1989 | PCT Int'l Appl. . | |
| 0579830 | 9/1976 | Sweden | 439/851 |

*Primary Examiner*—Gary F. Paumen

*Attorney, Agent, or Firm*—Eric J. Groen; Timothy J. Aberle

[57] ABSTRACT

A one piece electrical socket terminal is provided with an elongate socket comprising a tubular base. First and second contact springs extend forwardly from opposite side walls of the base, third and fourth contact springs projecting forwardly from the top wall of the base and fourth and fifth contact springs projecting forwardly from a bottom wall of the base. The contact springs on one side of a central longitudinal plane of the socket are connected to a first U-shaped strap, the contact springs on the other side of the central plane being connected to a second U-shaped strap. The first contact springs have opposite contact surfaces which are bisected by a central transverse plane of the socket, the contact surfaces of the remaining contact springs being equidistant from the transverse plane, for engaging respective faces of a square cross section electrical pin. The contact surfaces of the first and second contact springs are spaced forwardly from those of the remaining contact springs in order to reduce the insertion force of the pin.

8 Claims, 7 Drawing Sheets

ELECTRICAL SOCKET TERMINAL

BACKGROUND OF THE INVENTION

1. Field of the Invention

This invention relates to a one piece electrical socket terminal for mating with an electrical pin.

2. Description of the Prior Art

There is disclosed in U.S. Pat. No. 4,722,704, a one piece electrical socket terminal provided with an elongate socket having a central longitudinal plane and comprising a tubular base having a forward end, first and second contact springs on opposite sides of said central plane connected to, and projecting forwardly from, respective first and second opposite walls of the base, and third and fourth contact springs connected to, and projecting forwardly from, the base between said first and second walls of the base, the socket further comprising a forward portion to which the forward end of each contact spring is connected, each contact spring having an inwardly protruding contact surface intermediate the base and said forward portion.

This known terminal has four contact springs which are constantly angularly spaced form each other about the periphery of the forward end of the base of the socket. The forward portion of the socket is in the form of a single cylindrical piece. A contact surfaces of the first and second contact springs are spaced from those of the third and fourth contact springs axially of the socket.

European Patent Application No. 89901242.1 discloses an electrical socket terminal provided with a socket having a base having a forward portion, two L-cross section contact springs arranged in rotational symmetry and presenting orthoginal contact surfaces, extending between the base and the forward portion which is a single tubular structure.

The structure of the sockets of both of the known terminals described above, is such that no further contact springs could, even if it were thought to be desirable, be provided.

Such socket terminals are commonly used as connectors for mating with pin headers, especially in the automotive industry. Since such socket terminals, are, therefore, likely to be subjected, when in use, to a high degree of vibration, substantial contact surface redundancy should be provided for.

SUMMARY OF THE INVENTION

A one piece electrical socket terminal as defined in the second paragraph of this specification, is, according to the present invention, characterized in that said forward portion of the socket comprises first and second spaced, opposed straps, one on each side of said central plane, the third and fourth contact springs projecting, on opposite sides of central plane, from a third wall of the base and fifth and sixth contact springs on opposite sides of the central plane projecting forwardly from, and being connected to, a fourth wall of the base opposite to said third wall. The fifth and sixth contact springs have inwardly protruding contact surfaces. The forward ends of the contact springs on one side of the central plane are connected to the first strap and the forward ends of the contact springs on the other side of the central plane are connected to the second strap.

By virtue of this construction, two opposite sides of a pin when mated with the socket, will each be engaged by two of the contact surfaces, the pin also being confined between two further contact surfaces. Given that the inserted pin must displace six contact springs, it is preferred that the contact surfaces of the first and second contact springs be relatively axially displaced from those of the third, fourth, fifth and sixth contact springs so that the pin insertion force is reduced. This is of particular benefit where the terminal is to be used in a multi-position connector. The first and second contact springs are preferably of identical dimensions, so that the contact surfaces thereof exert an equal contact force against the mating pin, the remaining contact springs also being of identical dimensions to the same end.

For use with a pin of square cross section, the first and second contact surfaces are preferably bissected by a central transverse plane of the socket, the remaining contact surfaces being equidistant from the transverse plane. Since the tubular base of the socket will normally be rolled up in manufacture and so have a central longitudinal seam, the edges of the seam are preferably brazed together so that the tubular base is mechanically equivalent to a seamless tube, in the interest of equality of the contact forces acting upon the mating pin.

DETAILED DESCRIPTION OF THE PREFERRED EMBODIMENT

Figure 1:
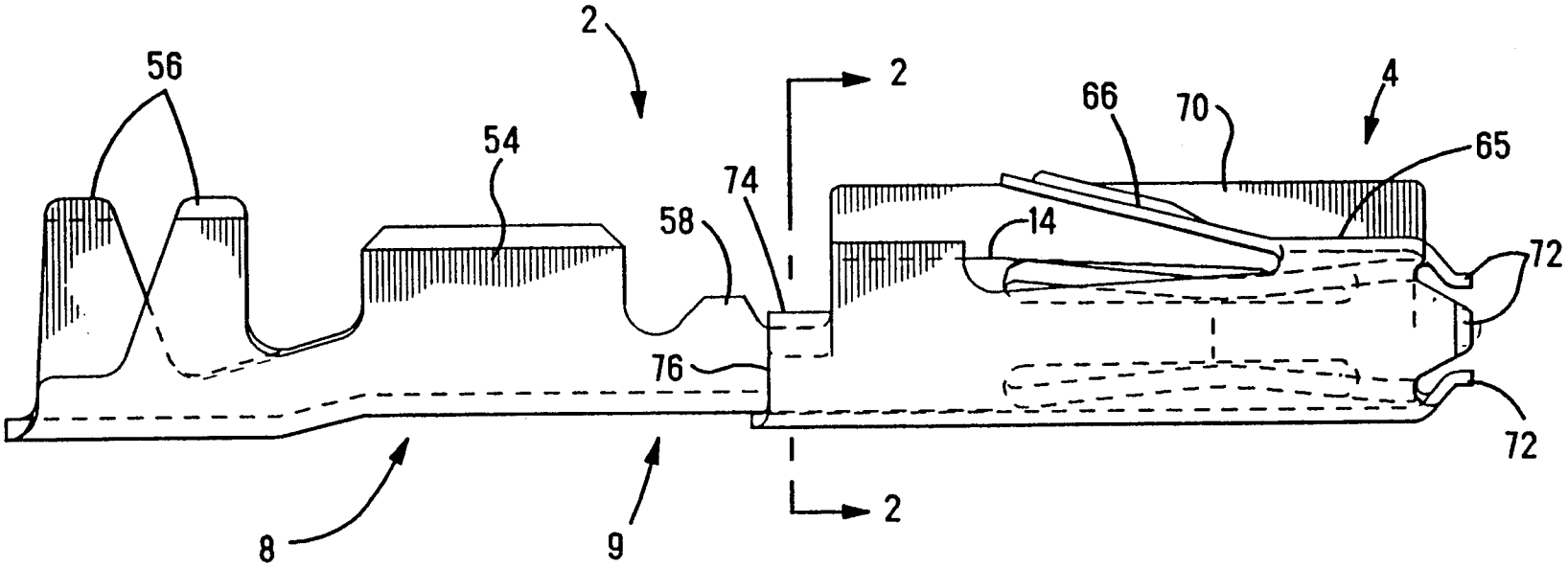
FIG. 1 is a side view of an electrical socket terminal provided with a protective metal sleeve.
Figure 2:
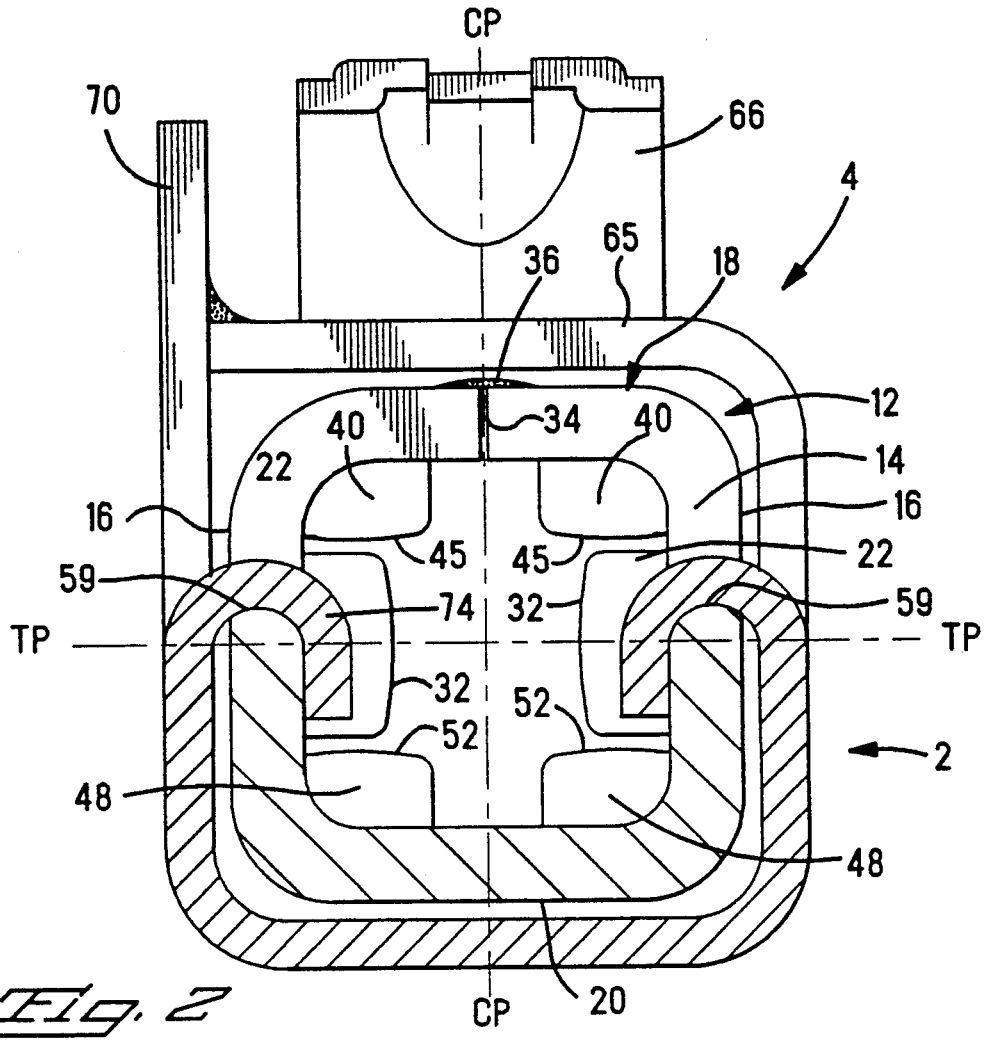
FIG. 2 is an enlarged view taken on the lines 2—2 of FIG. 1.

As shown in FIGS. 1 and 2, an electrical socket terminal 2 is provided with a protective sleeve 4. The socket terminal 2, which has been stamped and formed from a single piece of sheet metal stock, comprises a socket 6 and a wire connecting portion 8 joined to the socket 6 by a transition portion 9.

Figure 4:
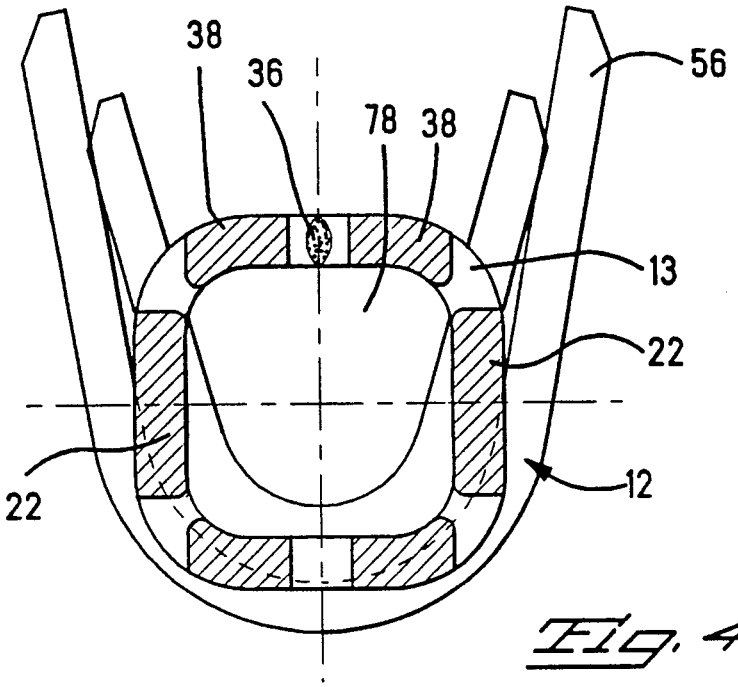
FIG. 4 is a view taken on the lines 4—4 of FIG. 3.
Figure 6:
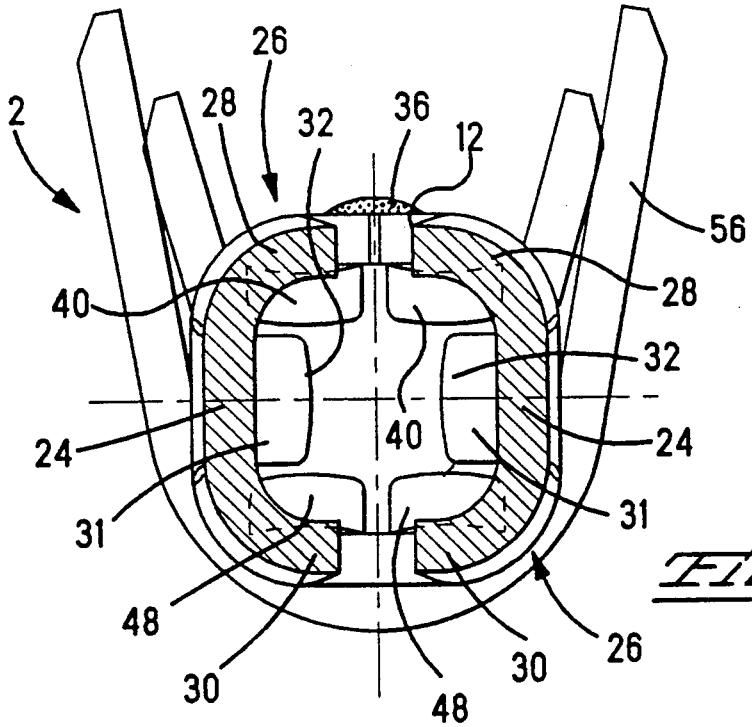
FIGS. 6 to 8 are views taken on the lines 6—6, 7—7, and 8—8 in FIG. 5.

The socket 6 comprises a substantially square cross section rear, tubular base 12, as best seen in FIGS. 2 and 4, which is of constant cross sectional area and has a forward end 13 and a rear end 14, the base 12 being open at both ends. The base 12 has opposite side walls 16 and opposite top and bottom walls 18 and 20, respectively. There projects forwardly from each side wall 16 of the base 12, a flat, strip like elongate, side contact spring 22 having parallel lateral edges. The springs 22 are of identical dimensions. The forward end of each spring 22 is connected to a respective side wall 24 of a respective U-shaped strap 26 having a top wall 28 and a bottom wall 30. Each contact spring 22 has, proximate to the respective side wall 24, a contact portion 31 which is bowed inwardly of the socket 6 so as to provide a slightly arcuate, inwardly protruding, and inwardly convex forward contact surface 32. The surfaces 32 are disposed exactly opposite to each other.

Figure 5:
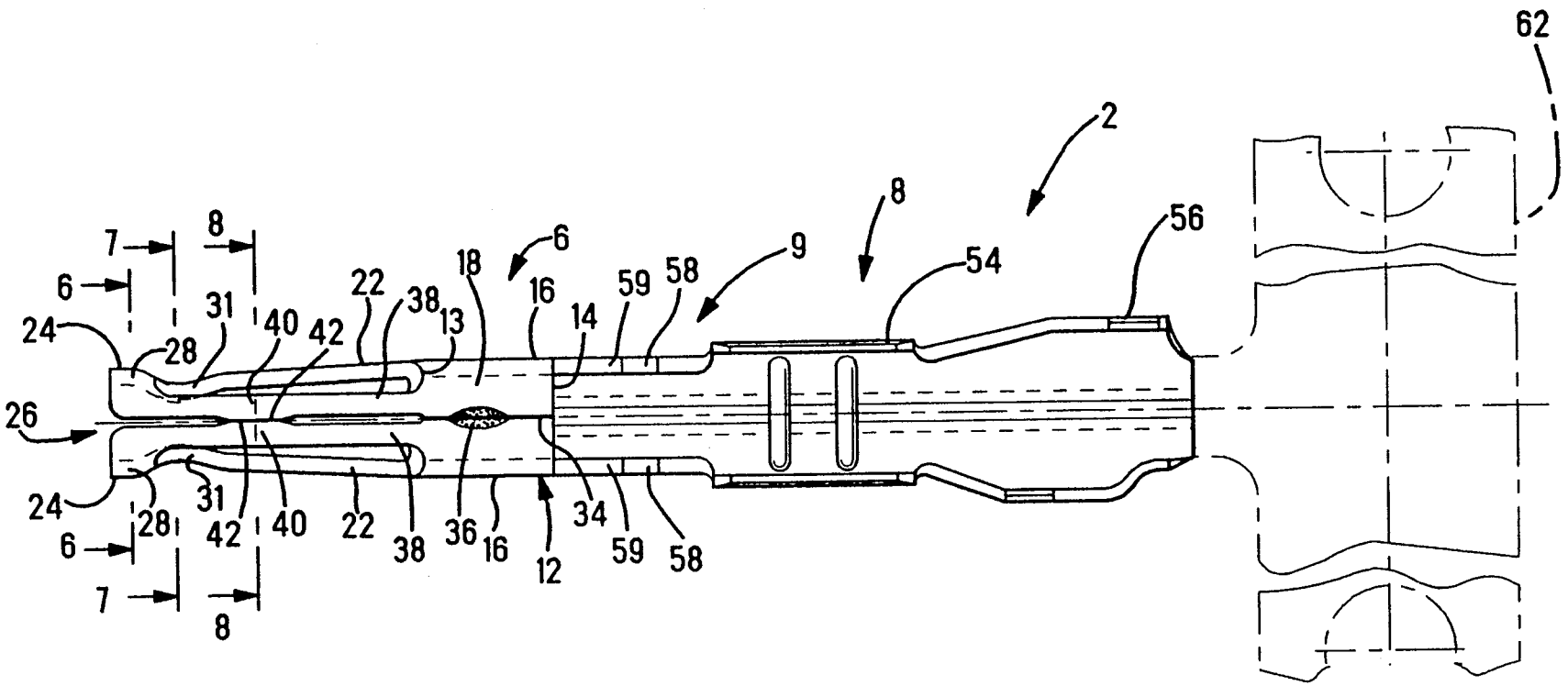
FIG. 5 is a top plan view of the socket terminal without the protective sleeve.
Figure 7:
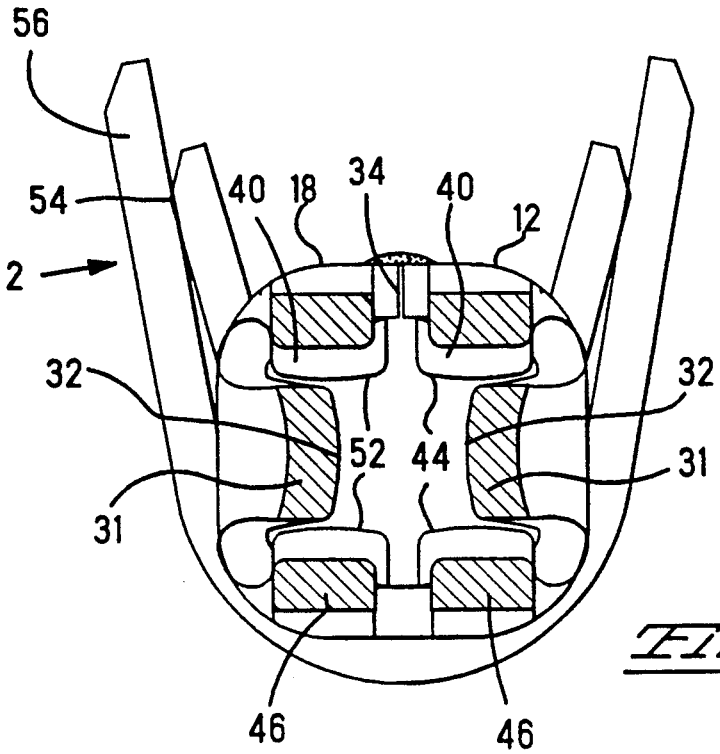
Figure 8:
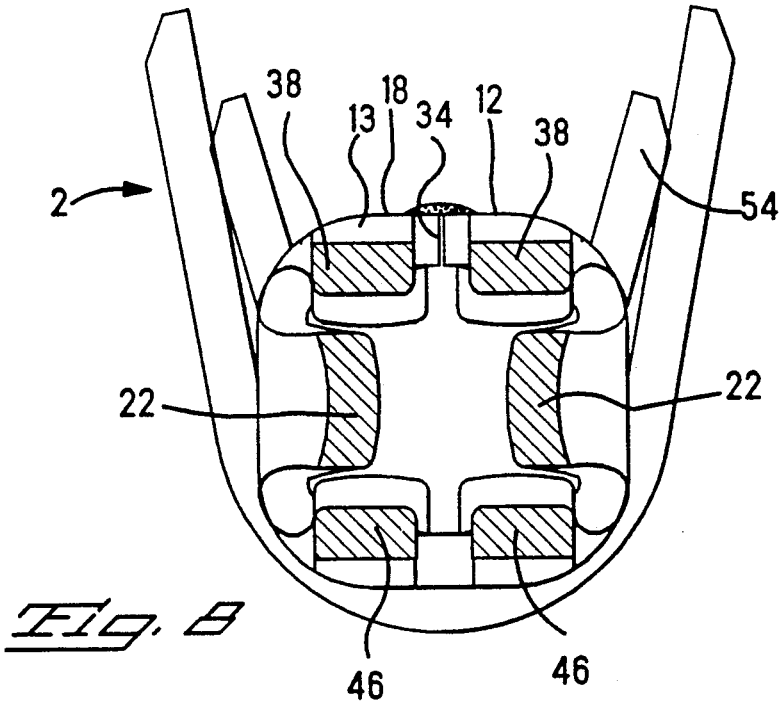

The top wall 18 of the base 12 has a central longitudinal seam 34, the edges of which have been brazed together by brazing metal 36, so that the base 12 is, in effect, a seamless tube. There extends forwardly from the forward end of the top wall 18 of the base 12, on each side of the seam 34, an elongate, flat, strip like, top contact spring 38, the springs 38 being of identical dimensions and each being connected at its forward end to the top wall 28 of a respective one of the straps 26. Intermediate its ends, each spring 38 has an inwardly enlarged section 40, the sections 40 being disposed opposite to each other and having lateral longitudinal edges 42 which are closely proximate to each other as best seen in FIG. 5. The section 40 of each spring 38 is inwardly bowed to provide a slightly arcuate, inwardly convex rear contact surface 44. From the forward edge of the bottom wall 20 of the base 12, there extends on either side of the seam 34, an elongate, flat, strip like bottom contact spring 46, the springs 46 being of equal dimensions and also being of the same dimensions as the top contact springs 34. Each contact spring 46 is connected at its forward end to the bottom wall 30 of a respective one of the straps 26.

Each contact spring 46 has an inwardly enlarged section 48, the sections 48 being opposite to each other and having lateral edges 50 which are closely proximate to each other. The section 48 of each spring 46 is inwardly bowed to provide a slightly arcuate, inwardly convex, rear contact surface 52. The rear contact surfaces 44 and 52 are spaced back from the forward contact surfaces 32 by approximately the same distance as the contact surfaces 32 are spaced back from the forward end of the socket 6. Each contact surface 44 on one side of the central longitudinal plane CP—CP of the socket 6 is disposed exactly opposite to the respective contact surface 52 on he same side of that plane, each pair of opposite contact surfaces 44 and 52, being equally spaced from the central transverse plane PP-TP of the socket 6, the contact surfaces 32 being bisected by the plane TP and being equidistant from the plane CP. Since the contact springs 22, 38 and 46 are separate from each other and are connected to the base 12 and to the straps 26, only, the contact springs are free to flex outwardly of the socket 6 independently of each other. The straps 26 being connected only to respective contact springs, are free to move away from each other.

The wire connecting portion 8 comprises a substantially U-shaped wire barrel 54 for crimping about the stripped end of the electrically conductive core of an insulated electrical lead (not shown), and a pair of upstanding ears 56 for crimping about the insulation of the lead. The transition portion 9 which is also U-shaped has a pair of lugs 58 each upstanding from a respective side edge 59 of the portion 9.

Figure 3:
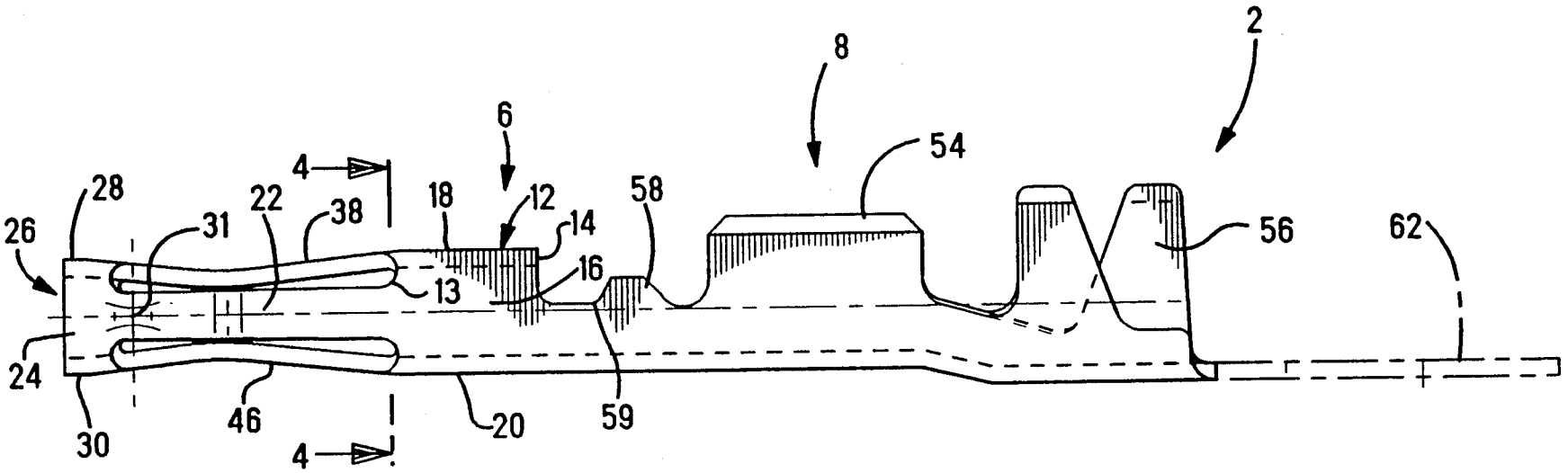
FIG. 3 is a side view of the socket terminal without the protective sleeve.
Figure 9:
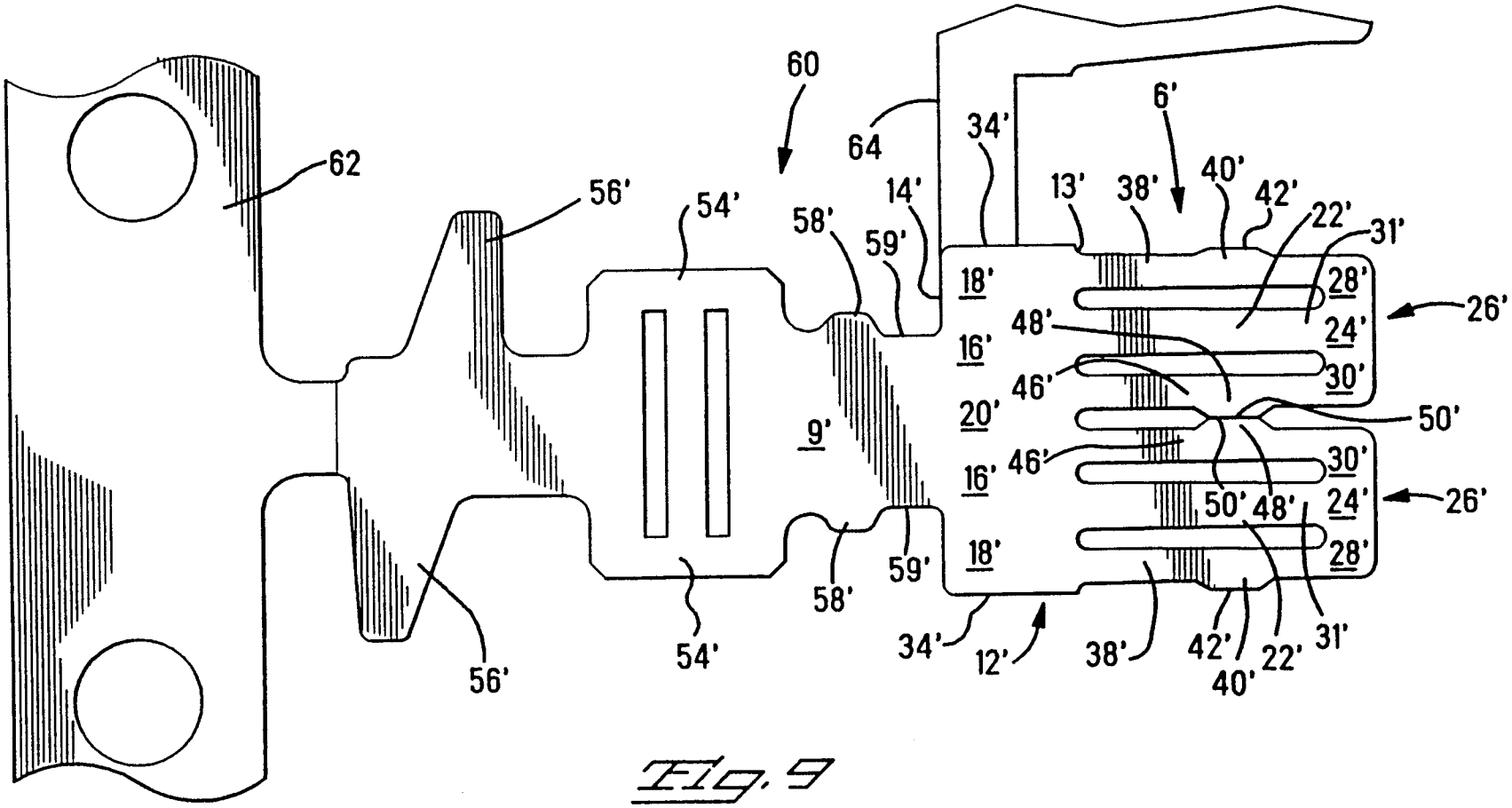
FIG. 9 is a plan view of a sheet metal blank from which the socket terminal was formed.

Terminals 2, for feeding to an electrical terminal applicator (not shown) are manufactured in side strip form by a progressive stamping and forming operation in which metal blanks 60 (FIG. 9) are struck out from a continuous strip of sheet metal stock, leaving the blanks 60 connected by carrier strips 62 and 64, after which the blanks 60 are formed progressively to the shape of the terminals 2 and the carrier strips 64 are severed from the blanks 60, leaving the terminals 2 connected at their rear ends, only by the carrier strip 62. In FIG. 9, the parts of the complete blank 60 shown therein, which parts correspond to respective parts described above of the terminal 2, bear the same reference numerals as those parts but with the addition of the prime symbol. The carrier strip 62 is shown in broken lines in FIGS. 3 and 5.

The protective sleeve 4 (FIGS. 1 and 2) which is of substantially square cross section and which was stamped and formed from a single piece of sheet metal stock, has, struck out from its top wall 65, a latching tongue 66 having a free end 68 for engaging a shoulder in a cavity in an insulating housing (not shown) in order to retain the terminal 2 therein. One side wall of the sleeve 4 has an upstanding extension 70 to provide a keying plate for reception in a groove in said housing, for orienting the terminal 2 with respect thereto. There project forwardly, from the forward end of the sleeve 4, obliquely inwardly directed retaining flanges 72. The sleeve 4 has at its rear end 76, a pair of opposed clinching ears 74. The sleeve 4 is assembled to the terminal 2 by inserting the latter with its forward end leading, through the rear end 46 of the sleeve 4, until the forward end of the socket 5 abuts the flanges 72, and then clinching the ears 74 about the transition portion 9 of the terminal 2, between the base 12 of the socket 6 and the lugs 58, so that the sleeve 4 is fixedly attached to the terminal 2.

Figure 10:
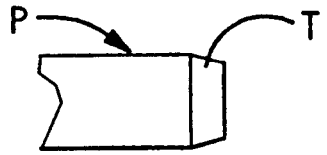
FIG. 10 is a side view of a front end portion of an electrical pin for mating with the socket terminal.
Figure 11:
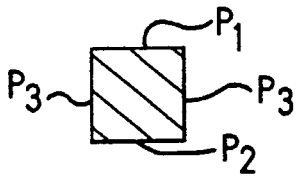
FIG. 11 is a cross sectional view of the pin.

The socket terminal 2 is for matting with a square cross section electrical pin P (FIGS. 10 and 11) in a pin header, for example, the pin P having a tapered leading end portion T, a top face P1, a bottom face P2 and opposite side faces P3. In order to mate the pin P with the socket 6, the pin P is inserted between the flanges 72 with the end portion T of the pin P leading, it being assumed by way of example that the face P1 of the pin P is uppermost. Initially, the pin P passes freely between the straps 26 which define an opening 78 FIG. 4) which is substantially oversized with respect to the maximum cross sectional area of the pin, until the portion T of the pin P engages between the forwarded contact surfaces 32 thereby forcing them, and the contact springs 22, and thus the straps 26, slightly apart, the springs 22 flexing normally of their own planes. When the portion T of the pin P has passed between the forward contact surfaces 32, the side faces P3 of the pin P, engage the contact surfaces 32. Since the contact springs 38 are connected to the contact springs 46 by way of respective straps 26, the springs 38 of each pair and the springs 46 of each pair are flexed slightly away from one another in their own planes. The contact forces applied by the contact surfaces 32 against the side faces P3 of the pin P are thereby augmented. The edges 42 and 50 of each proximate pair of these edges are accordingly also moved slightly apart. As the pin P is further advanced into the socket 6, the tapered portion T of the pin P engages the rear contact surfaces 44 and 52, thereby forcing them slightly apart, the upper and lower contact springs 38 and 46 being thereby flexed slightly outwardly, normally of their own planes until the top and bottom faces P1 and P2 of the pin P engage the rear contact surfaces 44 and 52, respectively. The pin P is then advanced to its desired axial position in the socket 6.

Since the forward contact surfaces 32 are spaced from the rear contact surfaces 44 and 52, axially of the socket 6, the insertion force needed to mate the pin P with the socket 6 is substantially lower than it would be if all the contact surfaces of the socket were positioned opposite to each other. Since the pin engages with six contact surfaces, each on a discreet contact spring, reliable electrical contact between the pin and the socket is maintained even in a severely vibratory environment, for example in a motor vehicle. Since the action of the contact springs 38 and 46 is identical, the contact force is exerted against the sides P1 and P2 of the pin P are equal, the actions of the contact springs 22 so being identical with each other although the contact forces exerted against the faces P3 of the pin P are slightly greater than those exerted by the contact springs 38 and 46.

I claim:

1. A one-piece electrical socket terminal provided with an elongate socket having a central longitudinal plane and comprising a tubular base having a forward end; first and second contact springs on opposite sides of said central plane, connected to, and projecting forwardly from, respective first and second opposite walls of the base, and third and fourth contact springs connected to, and projecting forwardly from, the base between said first and second walls of the base, the socket further comprising a forward portion to which the forward end of each contact spring is connected, each contact spring having an inwardly protruding contact surface intermediate the base and said forward portion of the socket;

characterized in that the forward portion of the socket comprises first and second spaced, opposed straps one on each side of said central plane, the third and fourth contact springs projecting, on opposite sides of said central plane from a third wall of the base, and fifth and sixth contact springs on opposite sides of said central plane and having inwardly protruding contact surfaces, projecting forwardly from and being connected to, a fourth wall of the base opposite to said third wall thereof, the forward ends of the contact springs on one side of the central plane being connected to the first strap and the forward ends of the contact springs on the opposite side of the central plane being connected to the second strap, wherein said central plane is generally perpendicular to said third and fourth walls of said base.

2. A terminal as claimed in claim 1, characterized in that the contact surfaces of the first and second contact springs are disposed at the forward ends thereof adjoining the respective straps, and opposite to each other, the contact surfaces of the third, fourth, fifth and sixth contact springs on each side of said central plane being disposed opposite to one another and being spaced rearwardly of the contact surfaces of the first and second contact springs.

3. A terminal as claimed in claim 1, characterized in that the contact surfaces of the first and second contact springs are equidistant from the central longitudinal plane and are bisected by a central transverse plane of the socket, the contact surfaces of the third, fourth, fifth and sixth contact springs being equidistant from both of said planes.

4. A terminal as claimed in claim 1, characterized in that said straps are U-shaped, each having a first wall which is substantially parallel with the central longitudinal plane and a pair of opposite second walls projecting towards that plane, the forward ends of the first and second contact springs being connected to the first walls of the respective straps, the forward ends of the third and fourth contact springs being connected to one of said opposite second walls of the respective strap and the forward ends of the fifth and sixth contact springs being connected to the other opposite second wall of the respective strap.

5. A terminal as claimed in claim 1, characterized in that the contact springs are elongate, flat, strip like parts of the socket, the contact surfaces of the third and fourth contact springs having laterally enlarged sections which are disposed opposite to each other and have lateral longitudinal edges which are closely proximate to each other, the contact surfaces of the third and fourth contact springs being formed on said enlarged opposite sections thereof, the fifth and sixth contact springs being identical with the third and fourth contact springs.

6. A terminal as claimed in claim 1, characterized in that the base of the socket is of substantially square cross section one of the walls of the base having a central longitudinal seam.

7. A terminal as claimed in claim 1, characterized in that said contact surfaces are dimensioned for engaging respective faces, of a square cross section electrical pin each contact surface being positioned to engage a respective one of said sides of the pin.

8. A one-piece electrical socket terminal provided with an elongate socket having a central longitudinal plane and comprising a tubular base having a forward end, first and second contact springs on opposite sides of said central plane, connected to, and projecting forwardly from, respective first and second opposite walls of the base, and third and fourth contact springs connected to, and projecting forwardly from, the base between said first and second walls of the base, the socket further comprising a forward portion to which the forward end of each contact spring is connected, each contact spring having an inwardly protruding contact surface intermediate the base and said forward portion of the socket;

characterized in that the forward portion of the socket comprises first and second spaced, opposed straps one on each side of said central plane, the third and fourth contact springs projecting, on opposite sides of said central plane from a third wall of the base, and fifth and sixth contact springs on opposite sides of said central plane and having inwardly protruding contact surfaces, projecting forwardly from and being connected to, a fourth wall of the base opposite to said third wall thereof, the forward ends of the contact springs on one side of the central plane being connected to the first strap and the forward ends of the contact springs on the opposite side of the central plane being connected to the second strap; and wherein said contact surfaces are dimensioned for engaging respective faces of a square cross section electrical pin, each contact surface being positioned to engage a respective one of said sides of the pin.

* * * * *